United States Patent [19]

Osgar et al.

[11] Patent Number: 5,031,801

[45] Date of Patent: Jul. 16, 1991

[54] TWO PART CLIP

[75] Inventors: Michael L. Osgar, Eagan; Joshua P. Waldman, Edina, both of Minn.

[73] Assignee: NOW Technologies, Inc., Bloomington, Minn.

[21] Appl. No.: 472,617

[22] Filed: Jan. 30, 1990

[51] Int. Cl.[5] ..... B67D 5/32; B67D 5/33

[52] U.S. Cl. ..... 222/153

[58] Field of Search ..... 222/185, 181, 153, 90, 222/83.5, 89, 81; 285/320, 317, 921

[56] References Cited

U.S. PATENT DOCUMENTS 593,191 11/1897 Bernhardt ..... 285/317 X 4,582,223 4/1986 Kobe ..... 222/395 X

OTHER PUBLICATIONS

Sales brochure of NOWPAK Chemical Handling Systems from Now Technologies.

*Primary Examiner*—Andres Kashnikow

*Assistant Examiner*—Lesley D. Morris

*Attorney, Agent, or Firm*—Kinney & Lange

[57] ABSTRACT

A liquid chemical handling system is suitable for handling a liquid chemical during dispensing. A container holds the liquid chemical and a collar couples the container to a dispenser during dispensing. A coupling clip, has a lever portion pivotally coupled to the collar. The coupling clip also has a locking tab pivotally coupled to a lever portion so that depression of the lever portion causes the locking tab to move between a locking position and an unlocking position. The coupling clip is also provided with a bias mechanism, which is coupled to the coupling clip, and which biases the lever portion to hold the locking tab in the locking position.

31 Claims, 5 Drawing Sheets

TWO PART CLIP

The following U.S. utility patent applications are hereby incorporated by reference:

The Osgar et al U.S. utility Pat. application Ser. No. 07/156,011 Filed Feb. 16, 1988 for CONTAINER AND DISPENSING SYSTEM FOR LIQUID CHEMICALS; and The file wrapper continuation of the above-identified U.S. utility patent application, Osgar et.al. U.S. utility continuation Pat. application Ser. No. 07/426,513 filed Oct. 20, 1989 for CONTAINER AND DISPENSING SYSTEM FOR LIQUID CHEMICALS.

BACKGROUND OF THE INVENTION

The present invention relates to a liquid chemical handling system. More particularly, the present invention relates to an apparatus for coupling portions of the liquid chemical handling system together to dispense liquid from a container holding the liquid chemical.

In a liquid chemical handling system of the type disclosed in U.S. utility Pat. application Ser. No. 07/426,513, a container is used for holding the liquid chemical. The container includes a fitment which is sealed to the mouth of the container. In order to dispense the liquid chemical from the container, a collar is coupled to the container. The collar, in turn, is coupled to a dispenser.

The method used for coupling the collar to the fitment and for coupling the dispenser to the collar in commercial embodiments of the liquid chemical handling system disclosed in the Osgar et.al. patent application includes single part clips. The single part clips have a first end used as a lever and a second end used as an integrally formed clip. As the lever end is depressed, the clip moves from a locking position along an arc pivoting radially away from the collar. The clip also includes a biasing mechanism for biasing the single part clip so that the clip is held in the locking position.

When the clip is in the locking position, it interacts with a notch on the fitment of the container to couple the collar to the container. However, as a separation force is exerted on the collar tending to urge the collar away from the container, the single part clips can fail. If enough separation force is used, the clips can "pop" open. This is primarily due to the arcing path of the single part clip during operation. Therefore, there is a continuing need for a coupling apparatus capable of securely coupling the collar to the fitment.

SUMMARY OF THE INVENTION

The present invention is a liquid chemical handling system with a container for holding the liquid and a collar for being coupled to the container during dispensing of the liquid. The present invention also includes a coupling clip for clipping the collar to the dispenser. The coupling clip has a lever portion pivotally coupled to the collar and a locking tab which is pivotally coupled to the lever portion so depression of the lever portion causes the locking tab to move between a locking position and an unlocking position. The coupling clip also includes bias means coupled to the lever portion for biasing the lever portion to hold the locking tab in the locking position.

DETAILED DESCRIPTION OF THE PREFERRED EMBODIMENTS

Figure 1:
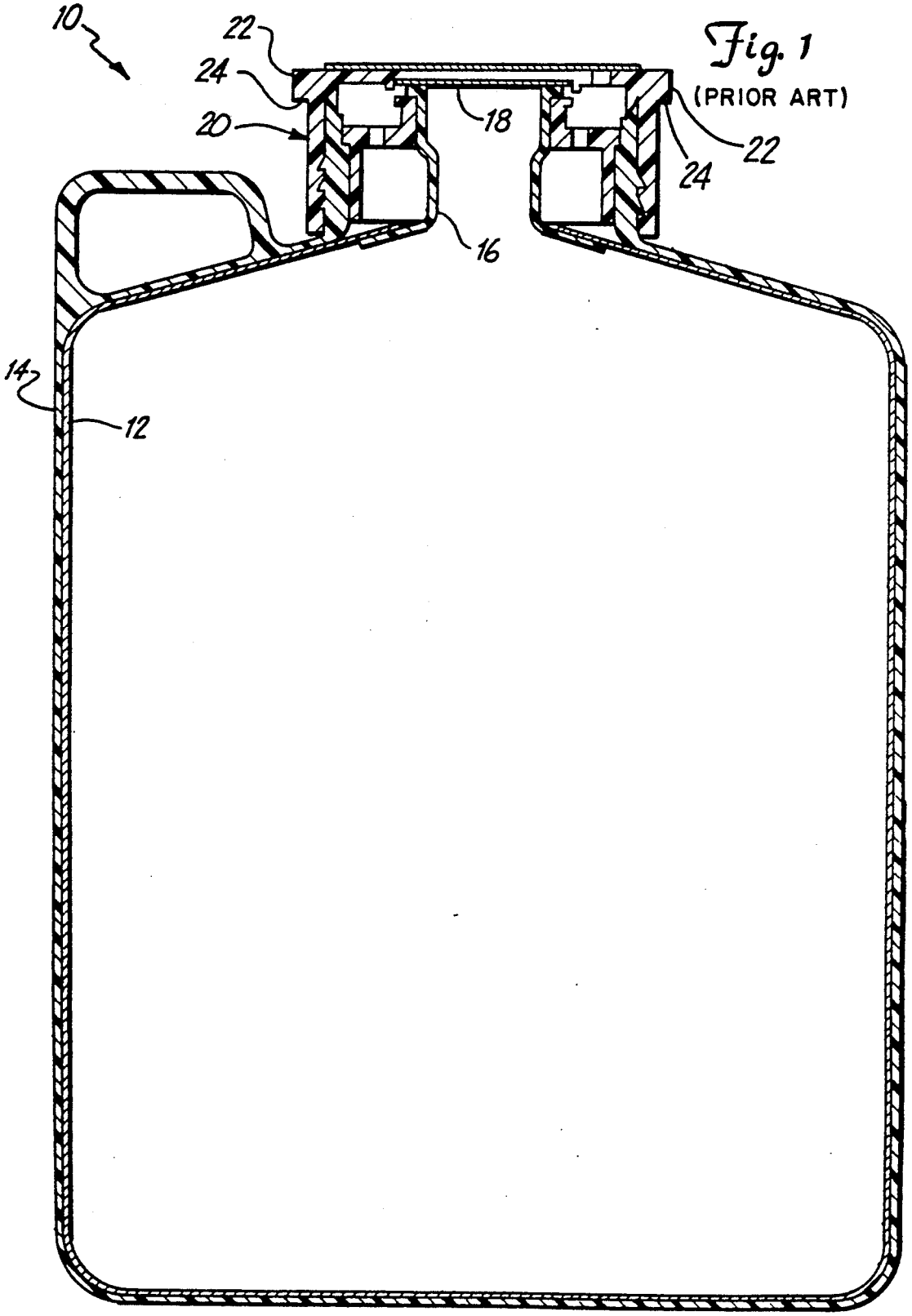
Fig. 1 (PRIOR ART)
FIG. 1 is a sectional view of a liquid chemical container of the prior art.

FIG. 1 is a sectional view of liquid chemical container 10 of the prior art. Container 10 includes inner pouch 12, outer bottle 14, fitment 16, seal 18 and a cap shown generally at 20. Cap 20 is fully described in U.S. utility Pat. application Ser. No. 07/426,513, filed Oct. 20, 1989 which is incorporated by reference in this patent application. However, of particular interest to the present invention is that cap 20 is provided with flange 22 which extends radially outward from the axial center of fitment 16 and provides annular coupling notch 24.

Figure 2:
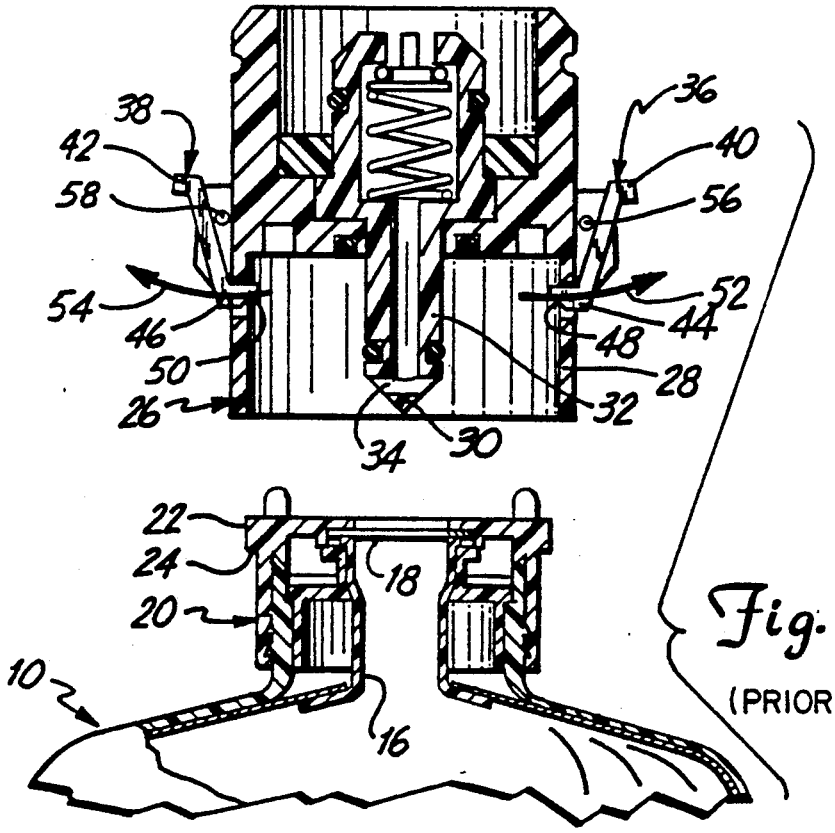
Fig. 2 (PRIOR ART)
FIG. 2 is a sectional, exploded view of the mouth portion of the container shown in FIG. 1 and a flange collar of the prior art.

FIG. 2 is a sectional view of cap 20 shown in FIG. and a flange collar shown generally at 26. Detailed operation of flange collar 26, as it cooperates with cap 20 of container 10 to dispense liquid from container 10, is disclosed in U.S Pat. application Ser. No. 07/426,513. Briefly, annular collar 28 is slid over flange 22 of cap 20. Pointed end 30 of probe 32 punctures seal 18. Hence, bore 34 of probe 30 forms a passage through which the liquid chemical in container 10 passes as it is dispensed from container 10.

Of particular note for the present invention are coupling clips shown generally at 36 and 38. Clips 36 and 38 each have a lever portion 40 and 42, respectively, which is integrally formed with clip tabs 44 and 46, respectively. The clip tabs have chamfered inner edges 48 and 50. As annular collar 28 is slid over flange 22, flange 22 engages chamfered edges 48 and 50 of clips 36 and 38. By continuing to slide collar 28 over flange 22, tabs 44 and 46 are forced outward along arcs 52 and 54 about pivot points 56 and 58, respectively. Tabs 44 and 46 move outward along arcs 52 and 54 until flange 22 clears the lower surfaces of tabs 44 and 46.

Clips 36 and 38 are biased to remain in the positions shown in FIG. 2. Therefore, once flange 22 is inserted into collar 28 past tabs 44 and 46, the tabs return to the locking position shown in FIG. 2 and engage coupling notch 24 thereby holding cap 20 within collar 28. Container 10, as well as flange collar 26, are then inverted and placed in a dispensing collar which is described in detail in U.S. Pat. application Ser. No. 07/426,513.

In order to remove flange collar 26 from cap 20, lever portions 40 and 42 of clips 36 and 38 are depressed. This causes clips 36 and 38 to pivot about pivot points 56 and 58 resulting in tabs 44 and 46 moving outwardly along arcs 52 and 54, respectively. When tabs 44 and 46 move far enough along arcs 52 and 54 so that the top edges of tabs 44 and 46 no longer engage coupling notch 24, flange collar 26 is separated from cap 20 and the lever portions 40 and 42 are again released to return to their original position shown in FIG. 2B.

Although clips 36 and 38 provide some force to keep flange collar 26 coupled to cap 20, they have an inherent shortcoming. After cap 20 is inserted into collar 28 and the top surfaces of clips 44 and 46 engage coupling notch 24, if flange collar 26 is urged up, away from cap 20, a resulting force is applied by coupling notch 24 downwardly against the upper edges of tabs 44 and 46. This urges tabs 44 and 46 to move downwardly and outwardly, along arcs 52 and 54, respectively. Hence, if enough force is exerted, tabs 44 and 46 fail by "popping" outwardly along arcs 52 and 54 and cap 20 comes uncoupled from flange collar 26. Hence, the arced path along which tabs 44 and 46 travel during operation is undesirable.

Figure 3:
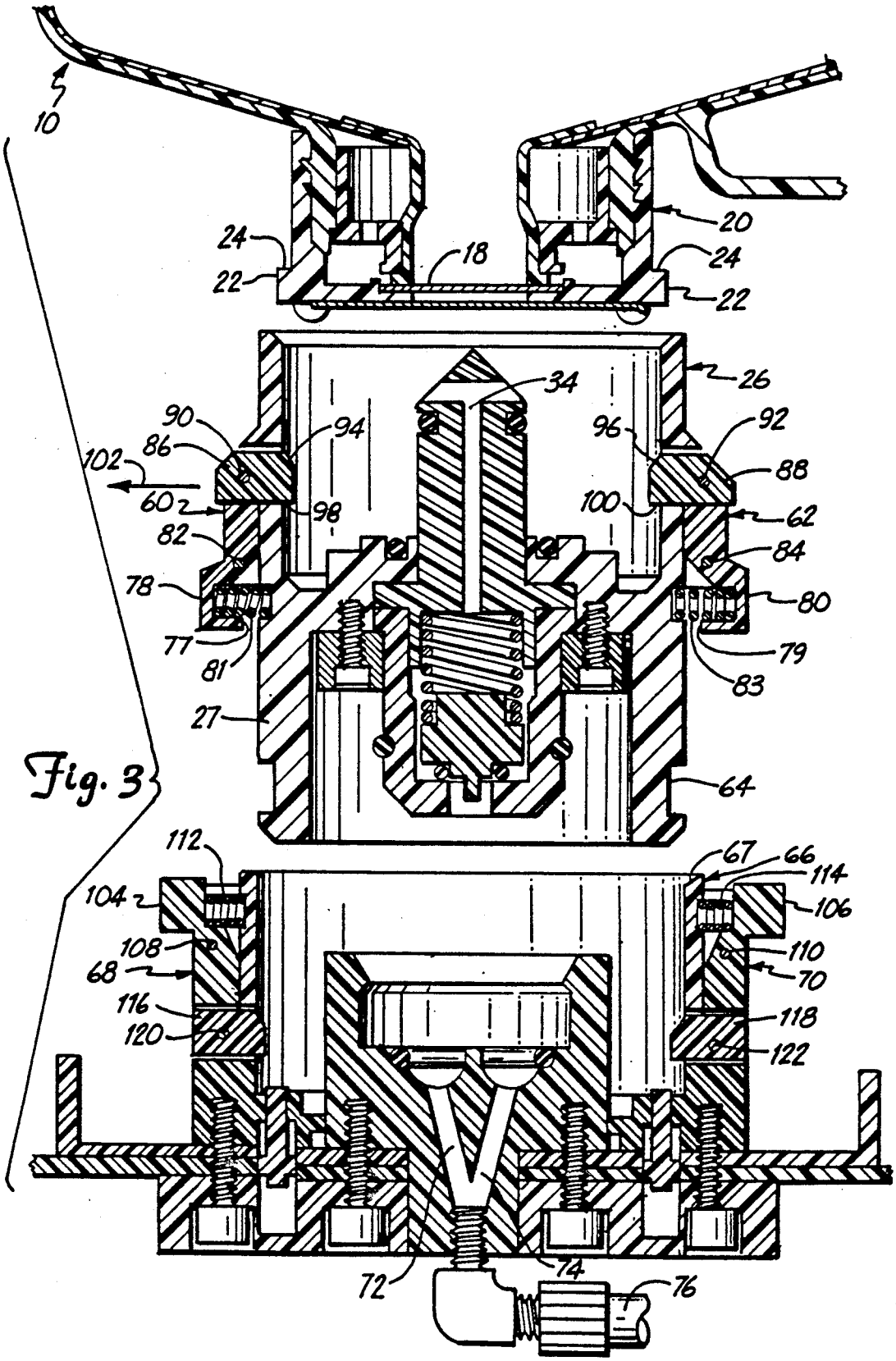
FIG. 3 is an enlarged, inverted sectional, exploded view of the mouth portion of the container shown in FIG. 1, a flange collar showing the clips of the present invention, and a base dispensing collar showing the clips of the present invention.

FIG. 3 is an enlarged sectional, exploded view of cap 20 shown in FIG. 2 and the flange collar 26 provided with the coupling clips 60 and 62 as well as annular coupling notch 64 of the present invention. FIG. 3 also shows a sectional view of base dispensing collar 66 with coupling clips 68 and 70 of the present invention.

A detailed description of the operation of cap 20, flange collar 26 and base dispensing collar 66 during dispensing is provided in U.S. Utility Pat. application Ser. No. 07/426,513. Briefly, cap 20 is slid within and coupled to flange collar 26. Flange collar 26, in turn, is slid into and coupled to base dispensing collar 66. Bore 34, provides a passage for the liquid chemical in container 10 to pass through flange collar 26 to base dispensing collar 66. There, bores 72 and 74 provide passages for the liquid chemical to flow into dispensing tube 76.

Clips 60 and 62 include lever portions 78 and 80 which are pivotally attached to flange collar 26 at pivot points 82 and 84, respectively. Clips 62 and 64 each have coupling tabs 86 and 88 which are pivotally attached to the lever portions at pivot points 90 and 92. Tabs 86 and 88 have chamfered upper edges 94 and 96 as well as locking edges 98 and 100.

Since clips 60 and 62 operate in substantially the same manner, for the sake of clarity only the operation of clip 60 is described. As cap 20 is slid within flange collar 26, flange 22 engages chamfered edge 94 of clip 60. By continuing to slide cap 20 within flange collar 26, tab 86 of clip 60 is urged linearly outward in the direction indicated by arrow 102. Once flange 22 has passed downward beyond tab 86, tab 86 returns to its original position shown in FIG. 3 because of a biasing force exerted outwardly on lever portion 78 by spring 81. This causes coupling edge 98 of tab 86 to engage annular coupling notch 24 of cap 20. The engagement of coupling surface 98 with annular coupling notch 24 securely locks cap 20 in place within flange collar 26.

In order to remove cap 20 from flange collar 26, lever portion 78 is depressed and pivots about pivot point 82. This causes tab 86 to move as well. Since tab 86 is pivotally coupled to lever portions 78 at pivot point 90, as lever portion 78 pivots about point 82, tab 86 pivots about pivot point 90 and coupling edge 98 moves linearly outwardly in the direction indicated by arrow 102. Once tab 86 moves outwardly far enough that coupling edge 98 no longer engages annular coupling notch 24, cap 20 is removed from within flange collar 26.

The linear motion of tab 86 during operation presents an advantage over the arced motion of tab 46 of the prior art. Any force exerted on cap 20 to remove it from within flange collar 26, while annular coupling notch 24 is in engagement with coupling edge 98, results in an upward force being exerted on coupling edge 98. That upward force is perpendicular to the direction of movement of edge 98 during operation since coupling edge 98 of tab 86 moves in a substantially linear manner in the direction indicated by arrow 102. Hence, tab 86 is not urged outwardly to disengage from coupling notch 24.

Clips 68 and 70 of base dispensing collar 66 are also comprised of lever portions 104 and 106 which are pivotally attached to base dispensing collar 66 at pivot points 108 and 110. Clips 68 and 70 also include bias springs 112 and 114 as Well as coupling tabs 116 and 118 which are pivotally attached to lever portions 104 and 106 at pivot points 120 and 122, respectively. The operation of clips 68 and 70 is substantially the same as the operation of clips 60 and 62.

Figure 4:
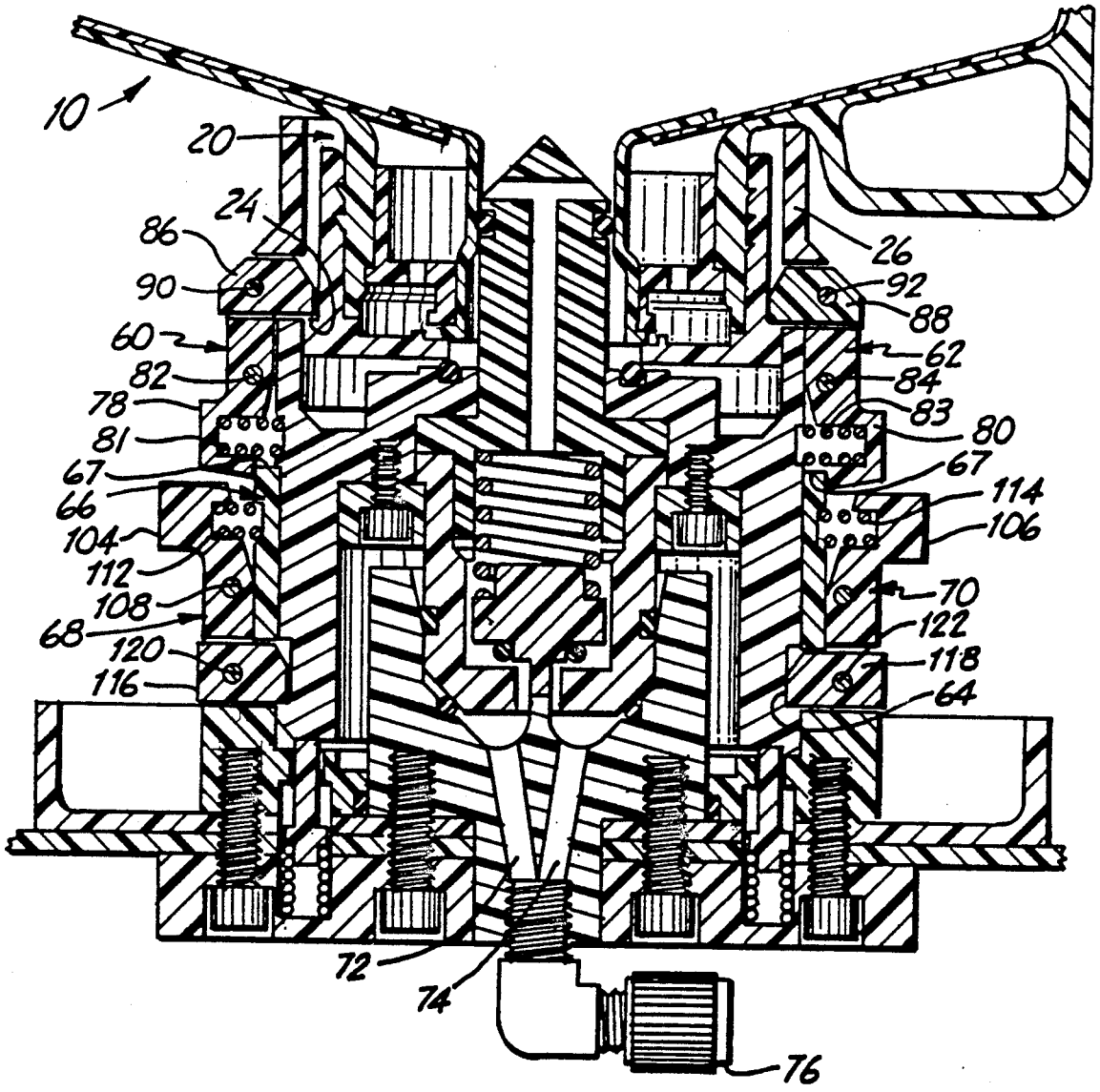
FIG. 4 is a sectional view showing the mouth portion coupled to the flange collar which is, in turn, coupled to the base dispensing collar.

FIG. 4 is a cross-sectional view of cap 20 coupled within flange collar 26, which is, in turn, coupled within base dispensing collar 66. It should be noted that upper edge 67 of base dispensing collar 66 extends upwardly within gaps between bottom edges 77 and 79, of lever portions 78 and 80, and housing 27 of flange collar 26. This arrangement effectively locks lever portions 78 and 80 of clips 60 and 62 in a non-depressed position, thereby locking clips 86 and 88 in a locking position with respect to annular coupling notch 24 of cap 20. This prevents accidental depression of lever portion, 78 and 80 of clips 60 and 62 which may result in container 10 being decoupled from flange collar 26 while container 10 is in the inverted position. That would result in excessive spillage of the liquid chemical held in container 10.

Figure 5A:
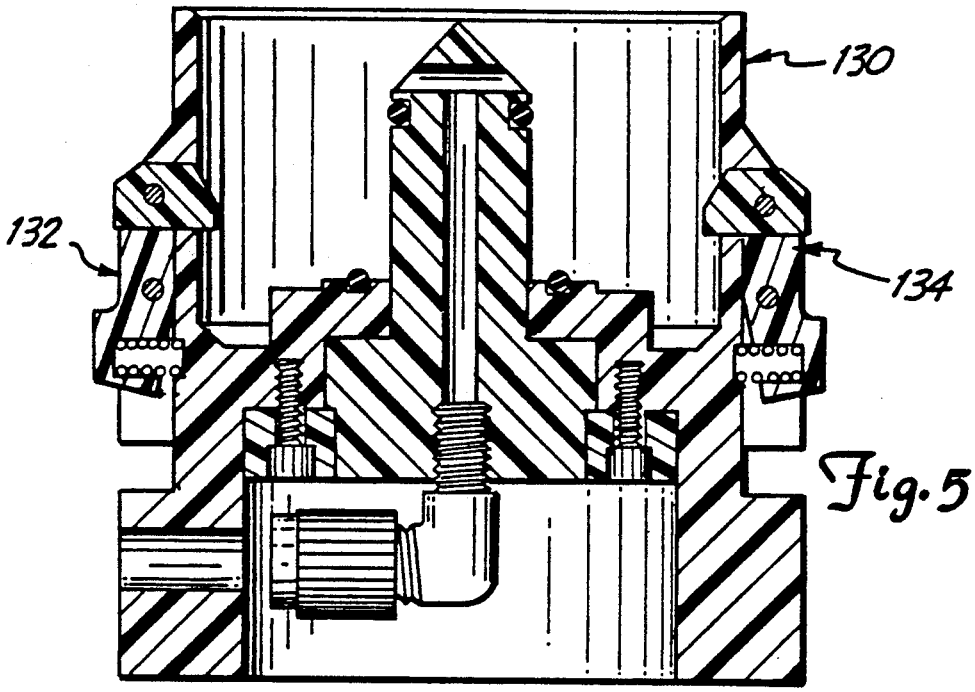
FIG. 5A is a sectional view of a second preferred embodiment of a base dispensing collar.

FIG. 5A shows another preferred embodiment of the present invention. In FIG. 5A, the base dispensing collar and the flange collar are combined into one dispensing collar 130. Hence, only one set of coupling clips 132 and 134 are required. Cap 20 is directly inserted into dispensing collar 130 and clips 132 and 134 operate in substantially the same manner as clips 60, 62, 68 and 70 to lock cap 20 within dispensing collar 130.

Figure 5B:
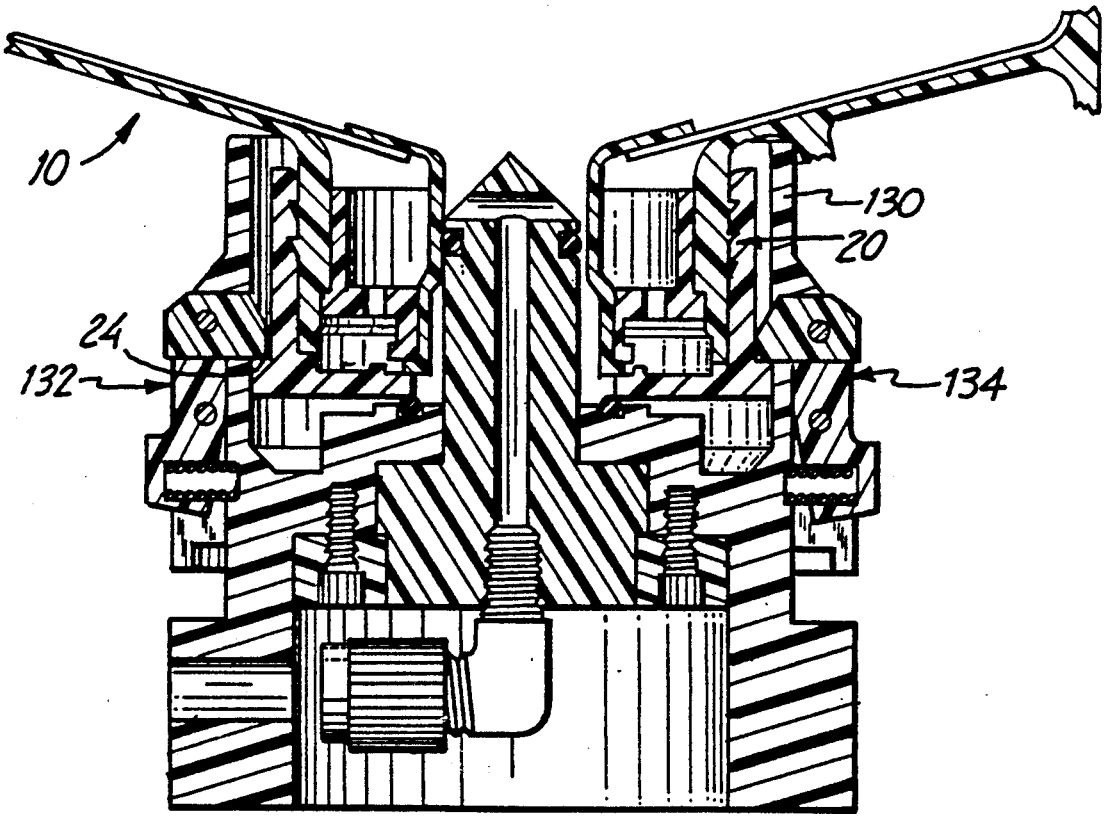
FIG. 5B is a sectional view showing the mouth portion of the container coupled to the base dispensing collar shown in FIG. 5A.

FIG. 5B shows cap 20 coupled to dispensing collar 130 shown in FIG. 5A.

The present invention provides a liquid chemical handling system with a two-part coupling clip for coupling cap 20 within flange collar 26 and for coupling flange collar 26 within base dispensing collar 66. The coupling clips have tabs, such as tab 86, which are pivotally attached to lever portions such as lever portion 78. Therefore, during operation, coupling edge 98 of tab 86 moves in a substantially linear direction rather than along an arc.

The substantially linear operation of tab 86 is advantageous. A force which urges annular coupling notch 24 upwardly against coupling surface 98 is perpendicular to the direction of motion in which coupling surface 98 travels during operation. Hence, coupling surface 98 is not urged in a direction which would cause disengagement of coupling edge 98 with annular coupling groove 24. This provides a more secure coupling arrangement between cap 20 and flange collar 26, as well as between flange collar 26 and base dispensing collar 66.

Although the present invention has been described with reference to preferred embodiments, workers skilled in the art will recognize that changes may be made in form and detail without departing from the spirit and scope of the invention.

What is claimed is:

1. A liquid chemical handling system, comprising:
a container for holding the liquid chemical;
a first flange collar having a coupling notch and being coupled to the container;
a second collar for being coupled to the first collar during dispensing of the liquid chemical from the container; and
a coupling clip for coupling the first collar to the second collar, the coupling clip having a lever portion pivotally coupled to the second collar, a locking tab for cooperating with the coupling notch of the first collar, and being substantially transverse to, and pivotally coupled to the lever portion, so depression of the lever portion causes the locking tab to move between a locking position and an unlocking position relative to the coupling notch, and bias means, coupled to the coupling clip, for biasing the lever portion to hold the locking tab in the locking position.

2. The liquid chemical handling system of claim 1 wherein a portion of the first collar fits within the second collar.

3. The liquid chemical handling system of claim 1 and further comprising:
a third collar, coupling the first collar to the container, having a port for communication with the interior of the container and having a coupling notch.

4. The liquid chemical handling system of claim 3 and further comprising:
a second coupling clip for coupling the first collar to the third collar, the coupling clip having a lever portion pivotally coupled to the first collar, a locking tab for cooperating with the coupling notch in the third collar and being substantially transverse to and pivotally mounted to the lever portion so depression of the lever portion causes the locking tab to move between a locking position and an unlocking position, and bias means, coupled to the second coupling clip, for biasing the lever portion to hold the locking tab in the locking position.

5. The liquid chemical handling system of claim 4 wherein a portion of the second collar engages the lever portion of the second coupling clip to hold the second coupling clip in the locking position when the second collar is coupled to the first collar.

6. The liquid handling system of claim 4 and further comprising:
a plurality of coupling clips for coupling the first collar to the second collar.

7. The liquid chemical handling system of claim 6 wherein each of the plurality of coupling clips comprises:
a lever portion pivotally coupled to the second collar;
a locking tab for cooperating with the coupling notch in the first collar and being substantially transverse to and pivotally mounted to the lever portion so depression of the lever portion causes the locking tab to move between a locking position and an unlocking position; and
bias means, coupled to the coupling clip, for biasing the lever portion to hold the locking tab in the locking position.

8. The liquid handling system of claim 4 and further comprising:
a plurality of coupling clips for coupling the first collar to the third collar.

9. The liquid handling system of claim 8 wherein each of the plurality of coupling clips comprises:
a lever portion pivotally coupled to the first collar;
a locking tab for cooperating with the coupling notch in the third collar and being substantially transverse to and pivotally mounted to the lever portion so depression of the lever portion causes the locking tab to move between a locking position and an unlocking position; and
bias means, coupled to the coupling clip, for biasing the lever portion to hold the locking tab in the locking position.

10. The liquid handling system of claim 9 wherein a portion of the second collar interacts with the lever portions of the plurality of coupling clips to lock the locking tabs in the locking position when the second collar is coupled to the first collar.

11. A liquid chemical handling system, comprising:
a container for holding the liquid chemical;
a fitment collar coupled to the container, having a coupling notch and having a port for communication with the interior of the container;
a flange collar for being coupled to the fitment collar for dispensing of the liquid chemical from the container;
a base dispensing collar for being coupled to the flange collar for dispensing of the liquid chemical from the container; and
a coupling clip for coupling the fitment collar to the flange collar, the coupling clip having a lever portion pivotally coupled to the flange collar, a tab portion for cooperation with the coupling notch in the fitment collar and being pivotally coupled to the lever portion so depression of the lever portion causes the tab portion to move between a locking position and an unlocking position, and bias means, coupled to the coupling clip, for biasing the lever portion to hold the locking tab in the locking position.

12. The liquid chemical handling system of claim 11 wherein a portion of the base dispensing collar engages the lever portion of the coupling clip coupled to the flange collar to lock the locking tab in the locking position when the base dispensing collar is coupled to the flange collar.

13. The liquid chemical handling system of claim 11 and further comprising:
a second coupling clip for coupling the flange collar to the base dispensing collar.

14. The liquid chemical handling system of claim 13 wherein the flange collar has a coupling notch, and wherein the second coupling clip comprises:
a lever portion pivotally coupled to the base dispensing collar;
a locking tab for cooperating with the coupling notch in the flange collar and being substantially transverse to and pivotally mounted to the lever portion so depression of the lever portion causes the locking tab to move between a locking position and an unlocking position; and
bias means, coupled to the second coupling clip, for biasing the lever portion to hold the locking tab in the locking position.

15. The liquid chemical handling system of claim 11 and further comprising:

a plurality of coupling clips for coupling the fitment collar to the flange collar.

16. The liquid chemical handling system of claim 15 wherein each of the plurality of coupling clips comprises:

a lever portion pivotally coupled to the flange collar;

a tab portion for cooperating with the coupling notch in the fitment collar and being pivotally coupled to the lever portion so depression of the lever portion causes the tab portion to move between a locking position and an unlocking position; and bias means, coupled to the coupling clip, for biasing the lever portion to hold the locking tab in the locking position.

17. The liquid chemical handling system of claim 16 wherein a portion of the base dispensing collar engages the lever portions of the plurality of coupling clips to hold the locking tabs in the locking position when the base dispensing collar is coupled to the flange collar.

18. The liquid chemical handling system of claim 11 and further comprising:

a plurality of coupling clips for coupling the flange collar to the dispensing collar.

19. The liquid chemical handling system of claim 18 wherein each of the plurality of coupling clips comprises:

a lever portion pivotally coupled to the base dispensing collar;

a locking tab for cooperating with the coupling notch in the flange collar and being substantially transverse to and pivotally mounted to the lever portion so depression of the lever portion causes the locking tab to move between a locking position and an unlocking position; and bias means, coupled to the coupling clip, for biasing the lever portion to hold the locking tab in the locking position.

20. A liquid chemical handling system suitable for handling a liquid chemical during dispensing by a dispenser, the handling system comprising:

a container for holding the liquid chemical;

a fitment coupled to the container and having a port for communication with the interior of the container and having a coupling notch;

coupling means for coupling the fitment to the dispenser during dispensing; and a coupling clip for clipping the coupling means to the dispenser, the coupling clip having a lever portion pivotally coupled to the coupling means, a locking tab pivotally coupled to the lever portion so depression of the lever portion causes the locking tab to move between a locking position and an unlocking position, and bias means, coupled to the coupling clip for biasing the lever portion to hold the locking tab in the locking position.

21. The liquid chemical handling system of claim 20 wherein the coupling means comprises:

a flange collar for coupling the fitment to the dispenser wherein the locking table of the coupling clip cooperates with the coupling notch in the fitment thereby coupling the fitment to the flange collar.

22. The liquid chemical handling system of claim 21 wherein the flange collar has a coupling notch.

23. The liquid chemical handling system of claim 22 wherein the coupling means further comprises:

a base dispensing collar, coupled to the dispenser, for coupling the flange collar to the dispenser.

24. The liquid chemical handling system of claim 23 wherein a portion of the base dispensing collar engages the lever portion of the coupling clip coupled to the flange collar for holding the locking tab in a locking position when the base dispensing collar is coupled to the flange collar.

25. The liquid chemical handling system of claim 24 and further comprising:

a second coupling clip for clipping the flange collar to the base dispensing collar.

26. The liquid chemical handling system of claim 25 wherein the second coupling clip comprises:

a lever portion pivotally coupled to the base dispensing collar;

a locking tab pivotally coupled to the lever portion so depression of the lever portion causes the locking tab to move between a locking position and an unlocking position; and bias means, coupled to the coupling clip, for biasing the lever portion to hold the locking tab in the locking position.

27. The liquid chemical handling system of claim 21 and further comprising:

a plurality of coupling clips for coupling the fitment to the flange collar.

28. The liquid chemical handling system of claim 27 wherein each of the plurality of coupling clips comprises:

a lever portion pivotally coupled to the flange collar;

a locking tab pivotally coupled to the lever portion so depression of the lever portion causes the locking tab to move between a locking position and an unlocking position; and bias means, coupled to the coupling clip, for biasing the lever portion to hold the locking tab in the locking position.

29. The liquid chemical handling system of claim 23 and further comprising:

a plurality of coupling clips for clipping the flange collar to the base dispensing collar.

30. The liquid chemical handling system of claim wherein each of the plurality of coupling clips comprises:

a lever portion pivotally coupled to the base dispensing collar;

a locking tab pivotally coupled to the lever portion so depression of the lever portion causes the locking tab to move between a locking position and an unlocking position; and bias means, coupled to the coupling clip, for biasing the lever portion to hold the locking tab in the locking position.

31. The liquid chemical handling system of claim 30 wherein a portion of the base dispensing collar engages the lever portions of the plurality of coupling clips coupled to the flange collar to hold the locking tabs in the locking position when the flange collar is coupled to the base dispensing collar.

* * * * *

UNITED STATES PATENT AND TRADEMARK OFFICE

CERTIFICATE OF CORRECTION

PATENT NO. : 5,031,801

DATED : July 16, 1991

INVENTOR(S) : Michael L. Osgar et al.

It is certified that error appears in the above-identified patent and that said Letters Patent is hereby corrected as shown below:

Col. 8, line 47, delete "claim", insert --claim 29--.

Signed and Sealed this

Seventeenth Day of November, 1992

*Attest:*

DOUGLAS B. COMER

*Attesting Officer*

*Acting Commissioner of Patents and Trademarks*